United States Patent [19]

Peckham

[11] Patent Number: 4,522,545

[45] Date of Patent: Jun. 11, 1985

[54] HOPPER CAR GATE OPENER AND METHOD OF OPERATING A HOPPER CAR GATE

[76] Inventor: George W. Peckham, Derby, Kans. 67037

[21] Appl. No.: 540,760

[22] Filed: Oct. 11, 1983

[51] Int. Cl.[3] ..... B65G 67/24

[52] U.S. Cl. ..... 414/376; 105/286

[58] Field of Search ..... 414/373, 376, 572, 786, 414/378; 105/286, 240; 104/162, 176, 257, 258, 259

[56] References Cited

U.S. PATENT DOCUMENTS

| | | | |
|---|---|---|---|
| 2,393,932 | 1/1946 | Petroe | 414/373 X |
| 2,623,476 | 12/1952 | Corrigan et al. | 414/572 |
| 3,187,684 | 6/1965 | Ortner | 414/376 X |
| 3,419,165 | 12/1968 | Haditsch | 414/376 |
| 3,738,511 | 6/1973 | Lemon et al. | 414/376 X |
| 3,965,760 | 6/1976 | Etheredge, Jr. | 414/376 X |
| 4,075,952 | 2/1978 | Burge | 105/282 R |

*Primary Examiner*—Robert J. Spar
*Assistant Examiner*—Stuart J. Millman
*Attorney, Agent, or Firm*—John H. Widdowson

[57] ABSTRACT

A hopper car gate opener comprising an elongated member having opposed flanges defining a fixed track; a trolley element mounted on the track supported by and movable along a top surface of each flange; and a portion of the trolley element underlaying and spaced from a bottom surface of each flange. A torque producing unit is mounted on the trolley element and is operable to generate a twisting moment in a predetermined rotational direction to drive a pinion of the gate. A method of operating the discharge gates of a hopper car having a plurality of gates where the gates are under control of rack and pinion sets individual thereto; providing a flanged track disposed generally parallel to the longitudinal axis of the car; mounting a trolley upon and movable along the track; and mounting a torque producing unit upon the trolley. The method additionally comprises positioning the trolley along the track so that the torque unit is aligned with the pinion, and connecting the torque unit to the pinion by means of an elongated shaft so that torque applied to the shaft drives the pinion which, in turn, drives the rack to operate the gate.

9 Claims, 4 Drawing Figures

HOPPER CAR GATE OPENER AND METHOD OF OPERATING A HOPPER CAR GATE

BACKGROUND OF THE INVENTION

1. Field of the Invention

This invention provides a novel gate opener for a freight hopper car. More specifically, this invention contemplates a novel hopper car gate opener and a method of operating the discharge gates of a hopper car.

2. Description of the Prior Art

U.S. Pat. No. 4,075,952 discloses an apparatus for opening a gear activated scissor-type hopper car pocket opener. The apparatus includes a shaft, slide members mounted on opposite outboard links of the shaft, links which fit into sockets connected to the gears of the opener and which are mounted on the slide members so that the links are free to move axially on the shaft, and means for axially moving the slide members toward the mid length of the shaft. This patent does not teach or suggest the particular hopper car gate opener and method of operating the hopper car discharge gates of this invention.

SUMMARY OF THE INVENTION

This invention accomplishes its desired objects by providing a hopper car gate opener comprising an elongated member having opposed flanges defining a fixed track, a trolley element mounted on the track supported by and movable along the top surface of each flange, and a portion of the trolley element underlaying and spaced from a bottom surface of each flange. A torque producing unit is mounted on the trolley element and is operable to generate a twisting moment in a predetermined rotational direction to drive a pinion of the gate. Reaction to the twisting moment is to effectively rotate the trolley element relative to the track so that the portion of the trolley element underlaying the bottom surface moves into contact with the bottom surface of each flange, effective to seize the trolley frictionally and releasably to the track. This invention further accomplishes its desired objects by providing a method of operating the discharge gates of a hopper car having a plurality of gates where the gates are under control of rack and pinion sets individual thereto. The method comprises the steps of providing a flanged track disposed generally parallel to the longitudinal axis of the car; mounting a trolley upon and movable along the track; mounting a torque producing unit upon the trolley; and positioning the trolley along the track so that the torque unit is aligned with the pinion. The method further comprises connecting the torque to the pinion by means of an elongated shaft so that torque applied to the shaft drives the pinion which, in turn, drives the rack to operate the gate.

It is an object of the invention to provide a novel hopper car gate opener which is capable of easily being assembled.

Still further objects of the invention reside in the provision of a method of operating hopper car discharge gates with a hopper car gate opener which can be easily transported, and is relatively inexpensive to manufacture.

These together with the various ancillary objects and features will become apparent as the following description proceeds, are attained by this invention, preferred embodiments being shown in the accompanying drawings, by way of example only, wherein:

DETAILED DESCRIPTION OF THE INVENTION

Figure 1:
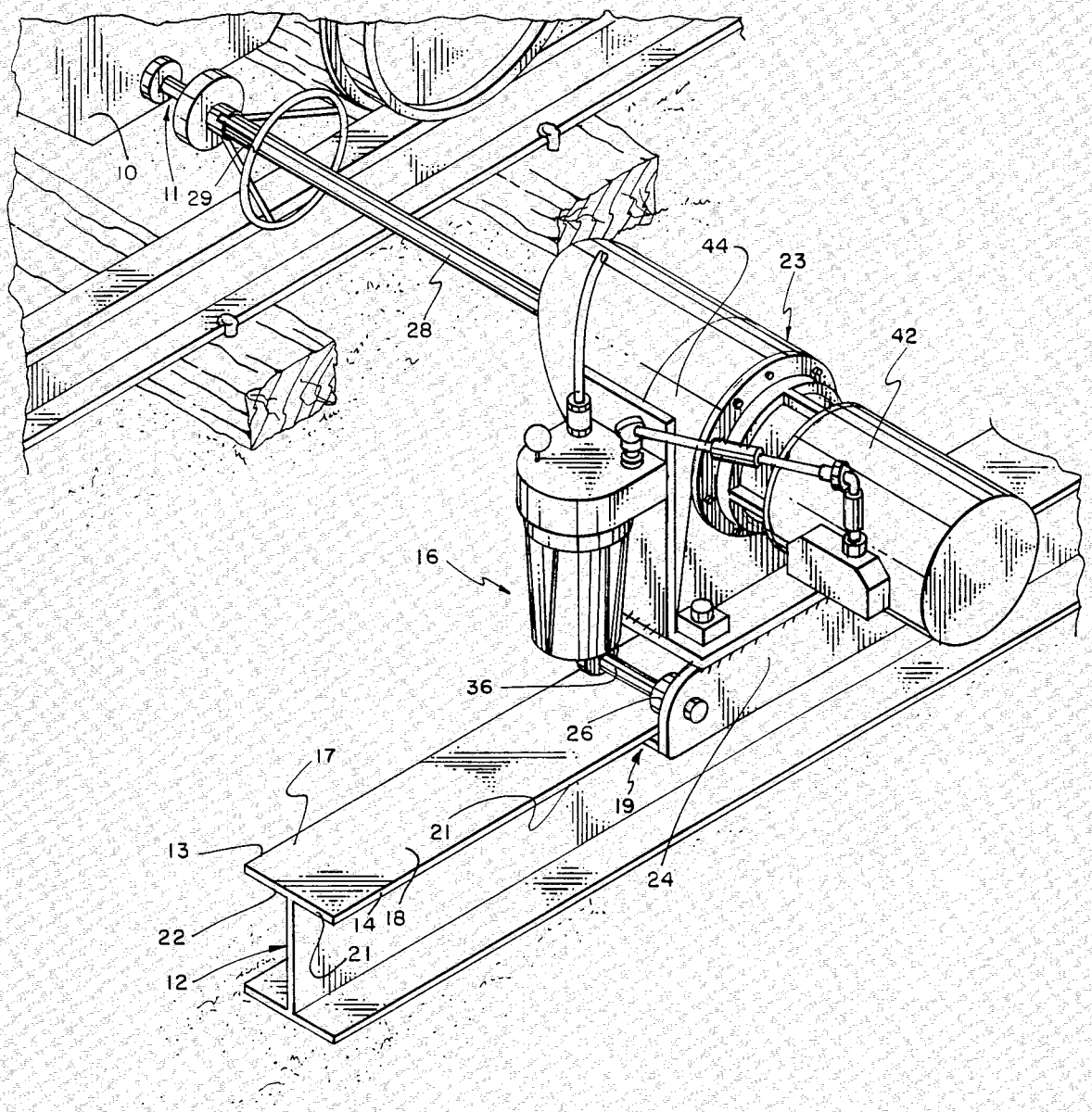
FIG. 1 is a perspective view of the hopper car gate opener.
Figure 2:
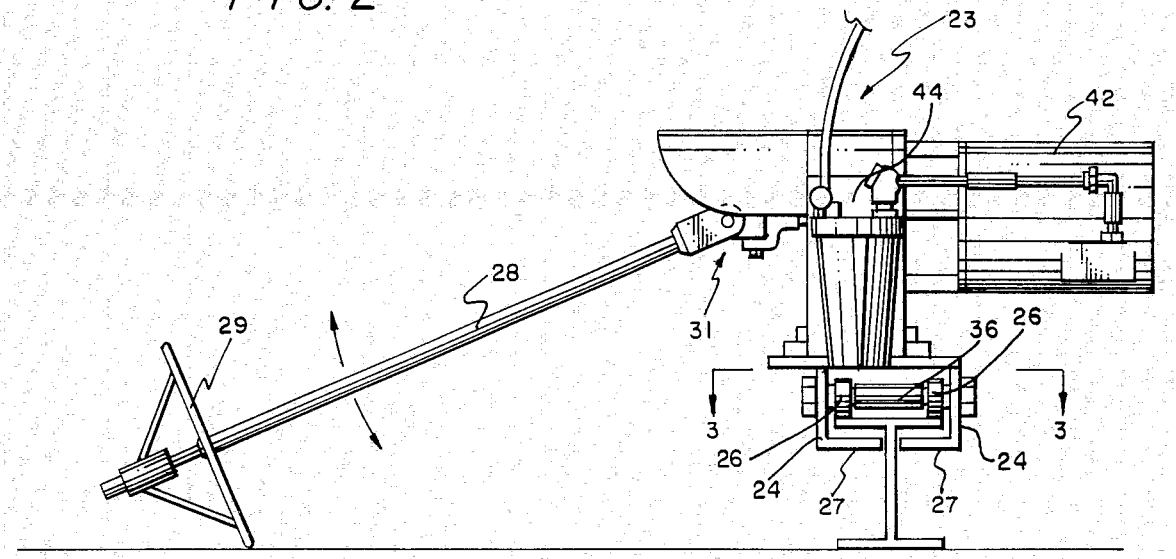
FIG. 2 is a side elevational view of the hopper car gate opener.
Figure 3:
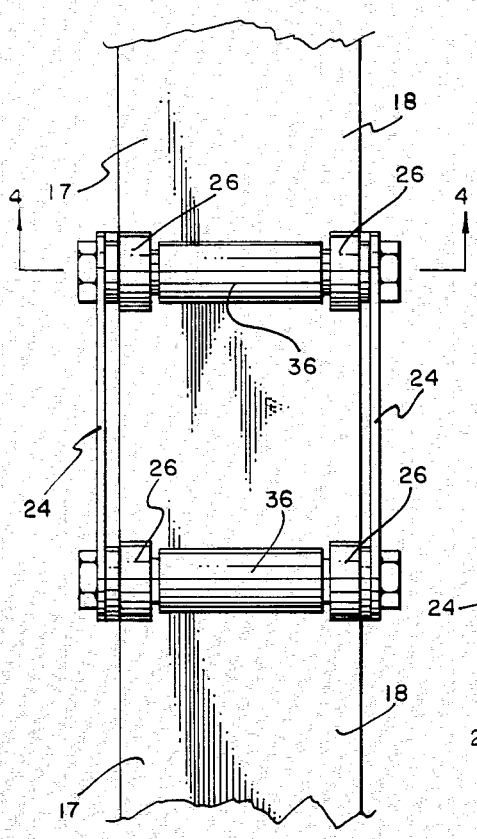
FIG. 3 is a horizontal sectional view taken in direction of the arrows and along the plane of line 3—3 in FIG. 2.

Referring in detail now to the drawings, wherein like reference numerals represent similar parts of the invention, there is a freight hopper car (not seen entirely in the drawings) having a plurality of hoppers 10 with rack and pinion operated gates, generally illustrated as 11, individual to each hopper 10. The gate opener (see FIG. 1) of this invention comprises an elongated I-member, generally illustrated as 12, having opposed flanges 13, 14 for defining a fixed track. A trolley element, generally illustrated as 16, is mounted on the defined fixed track and is supported by and movable along a top surface 17, 18 of each flange 13, 14, respectively. A portion, generally illustrated as 19, of the trolley element 16 underlays and is spaced from the bottom surface 21, 22 of each flange 13, 14, respectively. A torque producing unit, generally illustrated as 23, is mounted on the trolley element 16 and is operable to generate a twisting moment in a predetermined rotational direction to drive the pinion 11. In a preferred embodiment of the invention, torque producing unit 23 is a motor (preferably electric) 42 connected to a gear box 44 which in turn is connected via a universal joint 31 to a jack shaft 28 supporting a hand wheel 29. The end of the jack shaft 28 is adopted for insertion into the rack and pinion gates 11 on the hopper 10 to turn the same in operation to open the gates and empty the grain from the hoppers 10 into a bin underneath. Circular hand wheel 29 is used to better handle the gate opener device of this invention in mounting the same on the rack and pinion gates 11 on the hoppers 10.

Figure 4:
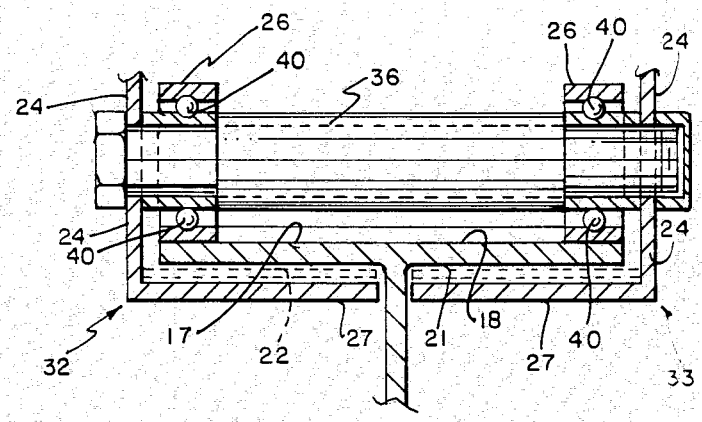
FIG. 4 is an enlarged partial vertical sectional view taken in direction of the arrows along the plane of line 4—4 in FIG. 3.

Reaction to the twisting moment from the torque producing unit 23 is effective to rotate the trolley element 16 relative to the defined track such that portion 19 of the trolley element 16, which underlays the bottom surface 21, 22, moves into contact with the bottom surface 21, 22 of each flange 13, 14 to frictionally seize and hold the trolley element 16 to the defined track (see FIG. 4 which illustrates the applied torque reaction twisting the trolley element 16 from solid line to dotted line position). Relaxing of the torque causes portion 19 of the trolley element 16 to be released from the bottom surface 21, 22 of each flange 13, 14.

The trolley element 16 includes a frame having a pair of opposed angles irons defining L-shaped webs 24–27, 24–27 disposed perpendicular with respect to one another. Webs 24, 24 provide rotatable support for a pair of shafts 36, 36 having rollers 26, 26 which ride traversely on the top surface 17, 18 of each flange 13, 14 respectively. Webs 27—27 underlay and are spaced from the bottom surface 21, 22 of each flange 13, 14 respectively. Spaced roller bearings 40, 40 are carried by each shaft 36 and are in rolling contact with the same and the rollers 26, 26 as shown in FIG. 4.

With continuing reference to the drawings for operation of the invention, the trolley element 16 is mounted on the defined I-member 12 fixed track. The torque producing unit 23 is mounted on the trolley element 16. Subsequently, the trolley element 16 is positioned along the defined track such that the torque producing unit 23 is aligned with the rack and pinion gates 11. Hand wheel 29 is utilized to facilitate the connecting of jack shaft 28 to the pinion gates 11.

Torque is applied to the jack shaft 28 by the torque producing unit 23 such that the shaft 28 drives the pinion which, in turn, drives the rack to operate the gate. The torque resulting from the turning of the jack shaft 28 by the torque producing unit 23 is great enough such that portion 19 (webs 27, 27) of the trolley element 16 that underlays the bottom surface 17, 18 pivots up against the bottom surface 17, 18 to lock or seize the trolley element 16 in position on the defined I-beam track. When the torque is relaxed, the trolley element 16 is freed from the defined track and can be sequentially positioned along the defined track in alignment with successive gates 10 in order to repeat the method or process.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. In a freight hopper car of the type having a plurality of hoppers with rack and pinion operated gates individual to each hopper, the improvement comprising an elongated member having opposed flanges defining a fixed track, a trolley element mounted on the track supported by and movable along a top surface of each flange, a portion of said trolley element underlaying and spaced from a bottom surface of each flange, and a torque producing unit mounted on the trolley element operable to generate a twisting moment in a predetermined rotational direction to drive said pinion, reaction to said twisting moment being effective to rotate the trolley element relative to the track so that said portion of said trolley element underlaying said bottom surface moves into contact with said bottom surface of each flange effective to seize the trolley frictionally and releasably to the track.

2. The device of claim 1 in which the trolley element includes a frame having a pair of webs disposed perpendicular to one another, a first web providing support for rollers riding on said top surface, and a second web underlaying and spaced from said bottom surface.

3. The device of claim 2 in which the torque unit includes an elongated shaft supporting a hand wheel at its distal end for facilitating adaptation of the shaft to the pinion.

4. The device of claim 3 in which the shaft is connected to the torque unit by means of a universal joint.

5. The device of claim 3 in which the trolley element includes a pair of opposed angle irons each having the first web supporting a pair of shafts, the second web underlaying and spaced from said bottom surface, and spaced roller bearings carried by said shafts and in rolling contact with same and said rollers.

6. A method of operating the discharge gates of a hopper car having a plurality of gates where the gates are under control of rack and pinion sets individual thereto comprising the steps of: providing a flanged track disposed generally parallel to the longiaxis of the car;

mounting a trolley upon and movable along the track;

mounting a torque producing unit upon the trolley, positioning the trolley along the track so that the torque unit is aligned with the pinion;

connecting the torque unit to the pinion by means of an elongated shaft so that the torque applied to the shaft drives the pinion which, in turn, drives the rack to operate the gate.

7. The method of claim 6 in which torque reaction is utilized to seize and fix the trolley releasably to the track.

8. The method of claim 6 in which one end of the shaft is provided with a hand wheel to facilitate connecting the torque unit to the pinion.

9. The method of claim 7 in which the torque is relaxed freeing the trolley from the track and sequentially positioning the trolley along the track in alignment with successive gates and repeating the process.

* * * * *